US005983048A

United States Patent [19]

Moser

[11] Patent Number: 5,983,048

[45] Date of Patent: Nov. 9, 1999

[54] DROOP COMPENSATED FUSER

[75] Inventor: Rabin Moser, Victor, N.Y.

[73] Assignee: Xerox Corporation, Stamford, Conn.

[21] Appl. No.: 09/113,388

[22] Filed: Jul. 10, 1998

[51] Int. Cl.[6] ..... G03G 15/20

[52] U.S. Cl. ..... 399/67; 399/320

[58] Field of Search ..... 399/67, 69, 70, 399/88, 90, 328, 320; 219/216, 469, 470, 471; 492/46; 432/60

[56] References Cited

U.S. PATENT DOCUMENTS

| | | | |
|---|---|---|---|
| 3,566,076 | 2/1971 | Fantuzzo | 219/216 |
| 3,679,302 | 7/1972 | Ludwig . | |
| 3,861,863 | 1/1975 | Kudsi | 432/60 |
| 4,197,445 | 4/1980 | Moser | 219/216 |
| 4,223,203 | 9/1980 | Elter | 219/216 |
| 4,567,349 | 1/1986 | Henry et al. | 219/216 |
| 4,627,813 | 12/1986 | Sasaki | 432/60 |
| 4,639,405 | 1/1987 | Franke | 430/124 |
| 4,653,396 | 3/1987 | Wennerberg | 492/46 |
| 4,791,447 | 12/1988 | Jacobs . | |
| 4,875,611 | 10/1989 | Poehlein et al. | 226/186 |
| 5,053,828 | 10/1991 | Ndebi et al. | 219/216 X |
| 5,521,688 | 5/1996 | Moser . | |
| 5,708,920 | 1/1998 | Ohnishi et al. | 399/69 |
| 5,801,360 | 9/1998 | Oba et al. | 219/216 |
| 5,869,809 | 2/1999 | Moser | 219/216 |

*Primary Examiner*—Sandra Brase

[57] ABSTRACT

A temperature droop compensated NFFR fuser having a preheater structure which conveys the substrate carrying toner images past a radiant heat contained therein and then into the nip of a pair of pressure engaged fuser rollers that form the NFFR fuser. One of the fuser rollers is heated by an internal heater which is supplied a constant level of power which generally maintains the temperature of the heated roller to a temperature sufficient to fuse the toner images on the substrate. The preheater structure warms the substrate carrying toner images prior to entry into the nip of the fuser rollers to compensate for the temporary temperature droop of the fuser rollers that is encountered when the fuser moves from a standby mode to an operating mode. The combination of pre-warmed substrate and the temperature to which the heated fuser roller droops is sufficient to completely fuse the toner images on the substrate. With time in the operating mode, the fuser rollers recover from droop and the radiant heat source in the preheater structure is turned off.

7 Claims, 3 Drawing Sheets

DROOP COMPENSATED FUSER

BACKGROUND OF THE INVENTION

This invention relates generally to a heat and pressure, color fuser for an electrophotographic printing machine, and more particularly the invention is directed to a droop compensated fuser.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to a donor roll is then deposited on a latent electrostatic images on a charge retentive surface which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material become tacky and coalesce. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. In a fuser where the nip is formed by the heated fuser roll, the heated fuser roll is provided with a layer or layers that are deformable by a harder pressure roll when the two rolls are pressure engaged. The length of the nip determines the dwell time or time that the toner particles remain in contact with the surface of the heated roll.

The heated fuser roll is usually the roll that contacts the toner images on a substrate such as plain paper. In any event, the roll contacting the toner images is usually provided with an adhesive (low surface energy) material for preventing toner offset to the fuser member. Three materials which are commonly used for such purposes are PFA™, Viton™ and silicone rubber.

NFFR fusers, as practiced by the industry, exhibit droop when the thermal load increases. The phenomena of droop occurs when a Nip Forming Fuser Roll (NFFR) switches from the standby mode of operation to the run mode. A large amount of thermal energy is initially removed from the heated fuser roll.

Due to thermal inertia of the fuser roll core, an internal lamp cannot prevent droop. In monochromatic (i.e. one color images only) fusers where droop takes place, the effect on copy quality is not visible or noticeable to the customer. In fusing color images, the fuser roll temperature adversely affects the appearance of the copy. Thus, the gloss and colors of color images can be adversely affected by droop. Therefore, it is desirable to maintain the fuser roll temperature at its standby value or in some other way minimize or eliminate the droop phenomena.

The object of this invention is to provide a NFFR color fuser wherein the phenomena of droop is minimized.

Following is a discussion of prior art, incorporated herein by reference, which may bear on the patentability of the present invention. In addition to possibly having some relevance to the question of patentability, these references, together with the detailed description to follow, may provide a better understanding and appreciation of the present invention.

U.S. Pat. No. 4,567,349 granted to Henry et al on Jan. 28, 1986 discloses a heat and pressure fuser apparatus for fixing toner images to a substrate. The apparatus is characterized by the fact that silicone oil release agent material which is usually required for such devices is unnecessary. The fuser member which contacts the toner images comprises an outer layer of solid abhesive material capable of retaining this property without degradation over the operating life of the apparatus. The fuser member is so constructed that the abhesive coating contributes to the formation of the nip created between the fuser member and a backup roller.

U.S. Pat. No. 4,197,445 granted to Rabin Moser on Apr. 8, 1980 discloses a heat and pressure roll fusing apparatus for fixing toner images to copy substrates, the toner comprising thermoplastic resin. The apparatus includes a heated fuser roll cooperating with a backup or pressure roll to form a nip through which the copy substrates pass at relatively high (i.e. 12–20 in./sec) speeds with the images contacting the heated roll. The heated fuser roll is characterized by a relatively thick (i.e. 10 mils or greater) outer layer or surface which by way of example is fabricated from a highly insulative material such as silicone rubber or Viton to which a low viscosity polymeric release fluid is applied. Elevating the temperature of the heated roll during a standby or warm-up is accomplished by an internally disposed heating element and the operating temperature thereof during the run mode of operation is effected by an external heater.

U.S. Pat. No. 5,869,809 relates to a NFFR fuser which does not exhibit the phenomena of droop which can occur when the fuser switches from a standby to a run mode of operation. The elimination of droop is effected using an external heat source which together with an internal source of heat supplies heat to the surface of the heated fuser member to maintain its surface temperature at a preset standby value until such time as the fuser roll core reaches a temperature level sufficient to maintain the heated fuser member surface at a substantially constant temperature during standby and run modes of operation.

U.S. Pat. No. 3,861,863 discloses a black and white image fuser comprising a first stage backside heater and a second stage soft roll fuser.

U.S. Pat. No. 3,679,302 discloses first and second stage radiant fusers.

U.S. Pat. No. 3,566,076 discloses the combination of radiant and pressure fusing.

U.S. Pat. No. 4,875,611 granted Oct. 24, 1989 discloses a copy media feed system including two pairs of feed rolls which are horizontally aligned to form nip areas to engage the media. Each feed roll pair comprises one drive roll and one idler roll. For one pair, the drive roll is an elastomer-covered, high friction roll and the idler roll is a hard, roll. For the second pair the drive roll is a hard, high friction roll and the idler roll is an elastomer-covered roll. This arrangement provides accurate control of the media velocity.

U.S. Pat. No. 4,791,447 granted Dec. 13, 1988 discloses a heat and pressure fusing apparatus for fixing color toner images to various types of copy substrates. The apparatus includes three roll members which cooperate to form a pair of nips. All substrates pass through a first nip and a deflector plate directs certain types of substrates through the second nip. Passage of the substrates through the first nip causes the images carried thereon to contact a conformable elastomeric surface while passage through the second nip causes them to contact a relatively rigid surface. Thus, glossy and matte color copies on substrates such as plain paper and high chroma transparencies are suitably produced in a color reproduction apparatus incorporating this fuser. Matte color copies are produced by passing the substrate through only the first nip while glossy color copies and high chroma transparencies are produced by passing the substrates through both nips.

U.S. Pat. No. 4,639,405 granted Jan. 27, 1987 discloses a method and apparatus for fixing toner images in which a copy sheet bearing unfixed toner is first passed through a pair of heated fuser rollers and is subsequently passed through surfacing rollers to provide a gloss to the toner image. In order to prevent curling of the copy sheet and blistering of the glossed image, the copy sheet is passed through a conditioner means, located between the fuser rollers and the surfacing rollers, for removing a substantial portion of the moisture from the copy sheet.

U.S. Pat. No. 4,627,813 granted Dec. 9, 1986 discloses a thermal fixing apparatus for use with a copying machine or electronic printer in which an operating temperature of the apparatus after energization is quickly reached. A pair of fixing rolls is provided, at least one of which in heated. The outer surface of the other is covered with an elastically deformable outer layer. The two rolls are pressed into abutment with one another to form a nip therebetween of the predetermined width. A plate-shaped heater element is disposed prior to the nip adjacent the path of conveyance of toner-image-bearing paper sheets to be fixed.

The plane of the heater element is preferably parallel to the plane of the paper.

The surface temperature of the heater element has a temperature higher at central portions than at widthwise ends thereof to provide uniform fixing conditions.

U.S. Pat. No. 4,223,203 granted Sep. 16, 1980 discloses a heat and pressure fusing apparatus for fixing toner images to copy substrates comprising a first fusing system consisting of a pair of nip forming rolls, one of which is provided with a conformable outer surface and a second fusing system consisting of a pair of nip forming rolls, one of which has a rigid outer surface. Copy substrates are passed sequentially through the nips of the first and second fusing systems, in that order such that the toner images sequentially contact the conformable outer surface and then the rigid outer surface.

U.S. Pat. No. 5,521,688 granted to Rabin Moser on May 28, 1996 discloses an image treatment method and apparatus for fusing color toner images to a substrate such that they exhibit uniform gloss and satisfactory color saturation. As disclosed in this patent there is provided two fusing structures, one for partially fusing toner images on a substrate and another for completing the fusing process. The two fusing structures are arranged such that the substrate carrying toner images passes through them sequentially.

BRIEF SUMMARY OF THE INVENTION

According to the intents and purposes of the present invention, there is provided a NFFR structure for fusing color images without the adverse affects of the droop phenomena. In prior art devices, this phenomena takes place when a NFFR switches from the standby mode of operation to the run mode.

The phenomena of droop is compensated for by pre-warming the substrate carrying the toner images to a temperature which enables the fusing of toner images at a lower fuser operating temperature. Thus, initial fuser temperature during a run mode is sufficient to produce adequately fused toner images due to the pre-warming of the image substrate. As the core temperature of an internally heated fuser member of the NFFR fuser increases, the heat requirement for pre-warming is diminished and when the proper core temperature is reached the surface temperature thereof is maintained by the internal heat source or lamp and the power to the pre-warming is turned off. The fuser of the present invention makes it unnecessary at the start of a run mode to maintain the roll fuser at the standby temperature because the elevated temperature of the substrate enables image fusing at a lesser fuser operating temperature.

DESCRIPTION OF THE PREFERRED EMBODIMENT(S) OF THE INVENTION

Figure 1:
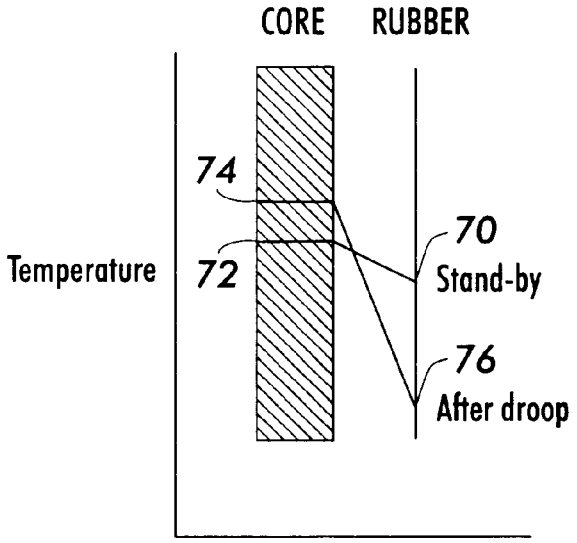
FIG. 1 Prior Art
FIG. 1 is a plot of temperature versus time depicting the phenomena of droop exhibited by a prior art fuser.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements.

Figure 5:
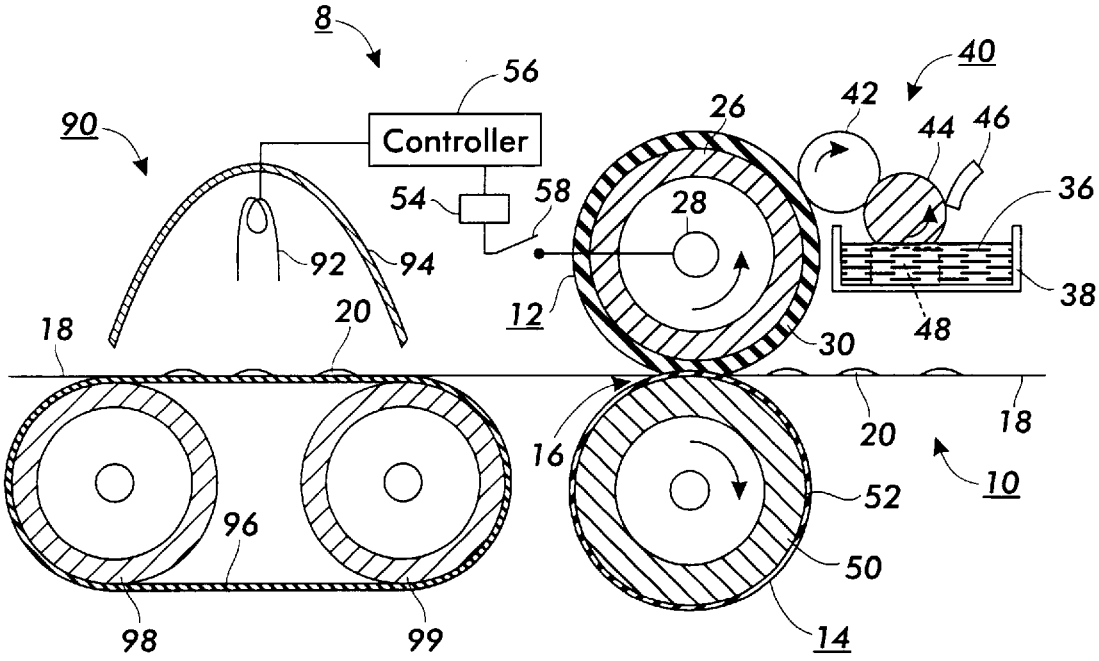
FIG. 5 is a schematic representation of a fuser according to the present invention.

FIG. 5 discloses a fuser structure 8 comprising a multi-layered Nip Forming Fuser Roll (NFFR) fuser structure generally indicated by reference character 10. The fuser apparatus comprises a heated roll structure 12 cooperating with a heated backup or pressure roll structure 14 to form a nip 16 through which a copy substrate 18 passes with toner images 20 formed thereon in a well known manner. Toner images 20 carried by a final substrate 18 contact the heated roll structure while a force is applied between the roll structures in a well known manner to create pressure therebetween resulting in the deformation of the heated fuser roll structure by the nonheated pressure roll structure to thereby form the nip 16.

As a substrate 18 passes out of the nip 16, it generally self strips except for very light weight ones. These substrates are led away from the fuser nip via a paper guide, not shown. After separating from the fuser roll, substrates are free to move along a predetermined path toward the exit of the machine (not shown) in which the fuser apparatus 10 is to be utilized.

A contact temperature sensor (not shown) is provided for sensing the surface temperature of the roll structure 12 and in conjunction with conventional circuitry maintains the surface temperature to a predetermined value, for example, on the order of 335–385° F. The heated roll structure 12 comprises a rigid core or hollow cylinder 26 having a radiant quartz heater 28 disposed in the hollow thereof. A deformable outer layer 30 may comprise Viton™ or silicone rubber which is adhered to the core 26 in a well known manner. The outer layer may have a thickness in the order of 10–150 mils.

Because the outer layer 30 is not adequately abhesive, it has been found desirable to coat this layer with a release agent material 36 contained in a sump 38. The material 36 comprises a polymeric release agent material such as silicone, mercapto or aminosilicone oil.

For the purpose of coating the heated roll structure 12 there is provided a Release Agent Management (RAM) system generally indicated by reference character 40. The mechanism 40 comprises a donor roll 42, metering roll 44, doctor blade 46 and a wick 48. The metering roll 44 is partially immersed in the release agent material 36 and is supported for rotation such that it is contacted by the donor roll 42 which, in turn, is supported so as to be contacted by the heated roll structure 12. As can be seen, the orientation of the rolls 42 and 44 is such as to provide a path for conveying material 36 from the sump to the surface of the heated roll structure 12. The metering roll is preferably a nickel or chrome plated steel roll having a 4–32 AA finish. The metering roll has an outside diameter of 1.0 inch. As mentioned above, the metering roll is supported for rotation, such rotation being derived by means of the positively driven heated roll structure 12 via the rotatably supported donor roll 42.

Wick 48 is fully immersed in the release agent and contacts the surface of the metering roll 44. The purpose of the wick is to provide an air seal which disturbs the air layer formed at the surface of the roll 44 during rotation thereof. If it were not for the function of the wick, the air layer would be coextensive with the surface of the roll immersed in the release agent thereby precluding contact between the metering roll and the release agent.

The doctor blade 46 preferably fabricated from Viton is ¾×⅛ in cross section and has a length coextensive with the metering roll. The edge of the blade contacting the metering roll has a radius of 0.001–0.010 inch. The blade functions to meter the release agent picked up by the roll 44 to a predetermined thickness, such thickness being of such a magnitude as to result in several microliters of release agent consumption per copy. The donor roll 42 has an outside diameter of 1.0 inch when the metering roll's outside diameter equals 1.0 inch. It will be appreciated that other dimensional combinations will yield satisfactory results. For example, 1.5 inch diameter rolls for the donor and metering rolls have been employed. The deformable layer 49 of the donor roll preferably comprises overcoated silicone rubber. However, other materials may also be employed.

The backup or pressure roll structure 14 comprises a relatively thick, rigid metal core 50 to which is adhered a relatively thin, elastomeric layer 52 of, for example, silicone rubber. The layer 52 may be overcoated with a thin layer of PFA (PerFluoroAlkoxy resin). Due to the construction of the pressure roll it deforms the deformable layer 30 of the heated roll structure when the required pressure is applied therebetween, the pressure being a function of the desired deformation which corresponds to the desired length of the nip 16.

In accordance with the invention, the heater element 28 serves to elevate the temperature of the roll structure 12 using a power supply 54. The operation of the power supply 54 at a constant input to the heater element is controlled using a controller 56.

The data acquisition, data storage, and computation, based upon temperature sensor readings and machine operations that are involved in this invention, are well within the capabilities of present and future microprocessorbased machine controllers.

When the quartz heater 28 is energized via the power supply 54 and the solenoid actuated switch 58, this heating element radiates heat to the rigid core 26 which is then conducted to the outer surface of an outer deformable layer 30 adhered to the rigid core 26.

Figure 2:
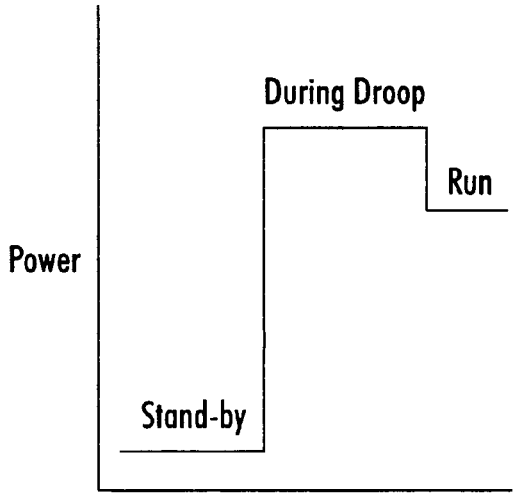
FIG. 2 Prior Art
FIG. 2 is a plot of power versus time exhibiting the phenomena of droop exhibited by a prior art fuser.

In operation of a prior art NFFR fuser, the heating element 28 maintains the fuser roll surface at a standby temperature of about 385° F. indicated by reference character 70 in FIG. 1. During standby, the temperature of the core 26 is represented by reference character 72. During a run mode, the core temperature rises to a value indicated by reference character 74. However, this rise is not fast enough to maintain the surface temperature of the layer at the required fusing temperature. The temperature of the outer layer's surface drops significantly to about 335° F. as indicated by reference character 76. This drop in temperature represents the droop that occurs in prior art fusers. The power input versus time to such a fuser as just described is illustrated in FIG. 2.

Figure 3:
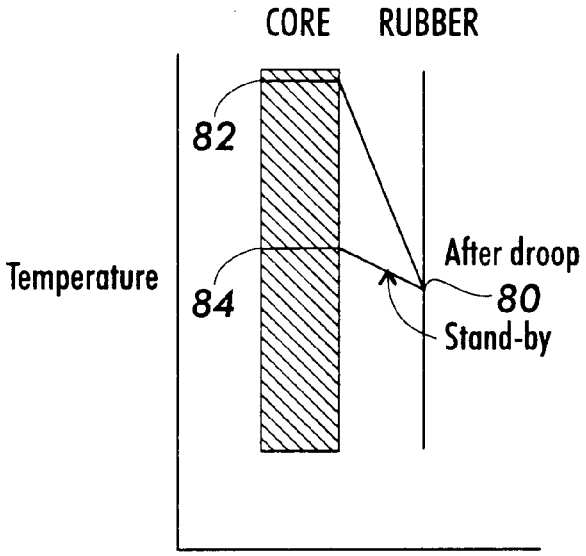
FIG. 3 is a plot of fuser/paper temperature versus time for a fuser according to the present invention.
Figure 4:
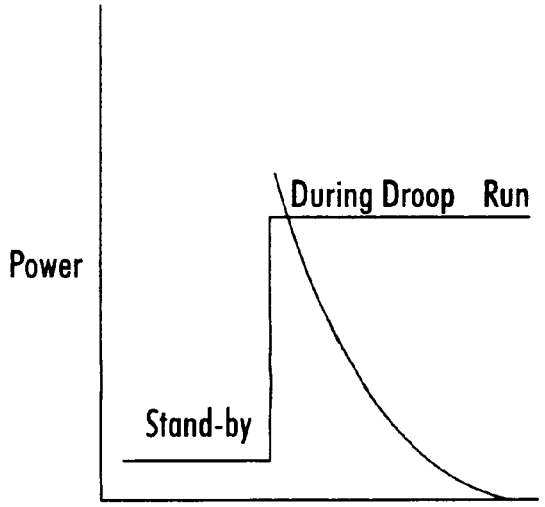
FIG. 4 is a schematic illustration of a heat and pressure roll fuser incorporating the invention.

In accordance with the another invention for controlling droop, as disclosed in the U.S. Pat. No. 5,869,809 application, an external heat source is used in conjunction with the internal heating element in such a manner that the surface temperature remains at substantially the standby temperature of 385° F. (See FIG. 3). Its power input, unlike that of the heating element 28, is not constant. On the contrary, the power supplied to the external source is for the sole purpose of maintaining the surface temperature of the layer 30 at the desired fusing temperature. It is only necessary to supply heat using the external lamp until such time as the core temperature is at a level such that the surface temperature can be maintained at the run value solely by the use of the internal heat source. As can be seen in FIG. 3, the surface temperature of the layer 30 is the same during standby and run modes of operation as indicated by reference character 80. As can be further seen from FIG. 3, the core temperature designated at 82 is substantially higher than the core temperature designated at 84 due to the cooperative operation of the two heat sources. With reference to FIG. 4, it can be seen that the power supplied by the heating element 28 is constant once it reaches its setpoint while the power supplied to the lamp external decreases to zero when the core temperature reaches a value at which the fuser roll surface can be maintained at the desired temperature through the use of only the internal heater.

According to the present invention as shown in FIG. 5, a preheater structure 90 forming a part of the fuser apparatus 8 is provided for elevating the temperature of the substrate 18 prior to the substrate being subjected to the NFFR fuser

Figure 6:
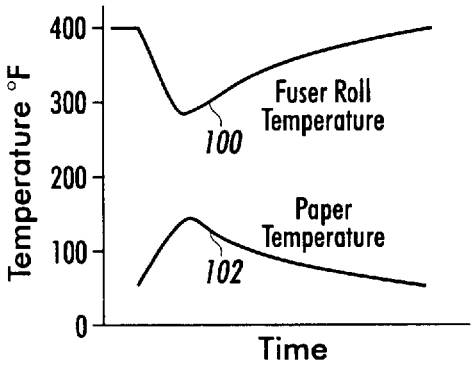
FIG. 6 is a plot of temperature versus time illustrating the phenomena of droop and droop compensation.

10. The preheater structure 90 comprises a radiant heat source 92 and a reflector element 94. A transport belt 96 supported for movement by a pair of rollers 98 and 99 moves a substrate into the nip of the NFFR fuser 10. The preheater under the control of the controller is operated such that the substrate temperature is raised to about 140° F. With the temperature of the substrate being so elevated, the operating temperature of the heated fuser member after droop occurs is sufficient to properly fuse the color toner images carried by the substrate. As shown in FIG. 6 by way of example, it can be seen from a consideration of curve 100 that the fuser roll standby temperature is 400° F. and after droop it is about 300° F. As operation of the heated fuser roll continues, its surface temperature approaches 400° F. thereby reducing the required thermal output of the preheater structure 90. As illustrated by curve 102 in FIG. 6, the temperature to which the paper is raised is reduced until the point where the heat source for the NFFR fuser can maintain the surface temperature of the fuser surface at the required temperature at which time the power supplied to the preheater is discontinued.

I claim:

1. A method of compensating for droop in a NFFR fuser, including the steps of:

rotating a pair of pressure engaged fuser members such that a substrate carrying toner images is moved therebetween;

heating one of said fuser members using an internal source of thermal energy;

supplying power to said internal source of thermal energy at a substantially constant level during standby and run operating modes of operation;

pre-warming said substrate carrying toner images by a preheater structure prior to moving said substrate with toner images thereon between the pair of pressure engaged fuser members;

supplying power to said preheater structure at a variable power level during said run modes of operation whereby the temperature of said substrate and toner images carried thereon is raised to a temperature sufficient to enable fusing of the toner images on said substrate when said substrate carrying toner images is moved between said fuser members in a run operating mode even though temperature droop occurs when said fuser members begin the run operating mode from a standby mode.

2. The method according to claim 1 wherein said step of supplying variable power to said preheater structure is effected until the temperature of said heated one of the fuser members is at a value sufficient to fuse the toner images carried on said substrate without pre-warming said substrate.

3. The method according to claim 1 wherein said step of supplying power to said preheater structure is effected until the temperature of said heated one of the fuser members is at a value sufficient to maintain an outer surface of said heated one of the fuser members at said substantially constant value.

4. The method as claimed in claim 1, wherein the method further includes the steps of:

sensing the temperature of an outer surface of the heated one of said fuser members; and controlling the power supplied to the preheater structured by a controller in response to the sensed temperature of the outer surface of the heated one of said fuser members in order to vary the pre-warming of the substrate as needed to compensate for droop.

5. The method as claimed in claim 4, wherein the temperature of the outer surface of the heated one of said fuser members is sensed by a contact sensor; and wherein the predetermined value of temperature at said outer surface of the heated one of the fuser members is between 300° F. to 400° F., with the lower temperature being caused by droop.

6. The method as claimed in claim 5 wherein the preheater structure comprises a radiant heat source; and wherein the variable power level supplied to the preheater structure heats the substrate carrying the toner images to a temperature up to 140° F. depending upon the sensed temperature of the outer surface of the heated one of said fuser members, the variable power level supplied to the preheater structure being discontinued when the sensed temperature of the outer surface of the heated one of the fuser members is 400° F.

7. The method as claimed in claim 6, wherein the substrate carrying toner images is moved through the preheater structure by a transport belt supported for movement by a pair of rollers, and wherein said transport belt moves the substrate from the preheater structure into a nip formed by said pair of fuser members.

* * * * *